US010349725B1

(12) United States Patent
Zadro et al.

(10) Patent No.: US 10,349,725 B1
(45) Date of Patent: Jul. 16, 2019

(54) ILLUMINATED SPOT MIRROR WITH RETRACTABLE SUCTION CUPS

(71) Applicants: Zlatko Zadro, Huntington Beach, CA (US); Alexander Ivan Zadro, Huntington Beach, CA (US); Elizabeth Zadro, Huntington Beach, CA (US)

(72) Inventors: Zlatko Zadro, Huntington Beach, CA (US); Alexander Ivan Zadro, Huntington Beach, CA (US); Elizabeth Zadro, Huntington Beach, CA (US)

( * ) Notice: Subject to any disclaimer, the term of this patent is extended or adjusted under 35 U.S.C. 154(b) by 0 days.

(21) Appl. No.: 15/924,210

(22) Filed: Mar. 17, 2018

Related U.S. Application Data

(60) Provisional application No. 62/473,320, filed on Mar. 18, 2017.

(51) Int. Cl.

| | |
|---|---|
| ***A45D 42/10*** | (2006.01) |
| ***A45D 42/00*** | (2006.01) |
| ***F21V 33/00*** | (2006.01) |
| ***A47G 1/02*** | (2006.01) |
| ***A47G 1/17*** | (2006.01) |
| *A47G 1/16* | (2006.01) |
| *F21Y 115/10* | (2016.01) |
| *A47G 1/00* | (2006.01) |

(52) U.S. Cl.
CPC ..... *A45D 42/00* (2013.01); *A47G 1/02* (2013.01); *A47G 1/17* (2013.01); *F21V 33/004* (2013.01); *A47G 2001/002* (2013.01); *A47G 2001/1673* (2013.01); *F21Y 2115/10* (2016.08)

(58) Field of Classification Search
CPC .. F21V 21/092; F21V 21/0925; F21V 33/004; A45D 42/10; A45D 42/14; A47G 1/02; A47G 1/17
USPC ..... 362/397; 248/467
See application file for complete search history.

(56) References Cited

U.S. PATENT DOCUMENTS

| | | | | |
|---|---|---|---|---|
| 3,996,947 A * | 12/1976 | Szpur | ..... | G02C 3/04 132/316 |
| 2004/0047052 A1* | 3/2004 | Zadro | ..... | A45D 42/16 359/855 |
| 2013/0148336 A1* | 6/2013 | Griggs | ..... | A45D 42/10 362/142 |

* cited by examiner

*Primary Examiner* — Sean P Gramling
*Assistant Examiner* — Keith G. Delahoussaye
(74) *Attorney, Agent, or Firm* — UltimatEdge IP Law Group, P.C.; Dean G. Stathakis

(57) ABSTRACT

A portable mirror includes a pancake-shaped housing which contains a concave reflective mirror plate in a front side of the housing and a circular array of suction cups attached to a rear wall of the housing by re-positionable joints that enable the suction cups to be slid radially outwards to facilitate temporarily attaching the mirror to a flat surface, and slid radially inwards into slots provided in the rear wall of the housing to retract the suction cups into positions which inhibit accidental adherence to or entanglement with items typically carried in a purse. The mirror includes an LED illuminator which is powered by an internal battery and extends outwardly from the housing and emits light upwardly and inwardly toward a longitudinal center line of the mirror plate, thus obliquely illuminating a face which may viewed in the mirror, while avoiding direct illumination of the eyes.

20 Claims, 12 Drawing Sheets

ILLUMINATED SPOT MIRROR WITH RETRACTABLE SUCTION CUPS

The present application claims priority of and to U.S. provisional patent application No. 62/473,320, filed Mar. 18, 2017.

BACKGROUND OF THE INVENTION

A. Field of the Invention

The present invention relates to small portable mirrors of the type which may be carried in a purse or travel bag and used to facilitate performance of personal appearance related functions such as applying makeup. More particularly, the invention relates to a novel compact mirror that has an integral battery-powered illuminator and suction cups which enable the mirror to be temporarily attached to a flat surface such as a bathroom vanity mirror, the suction cups being retractable into the mirror housing after removal of the mirror from a mounting surface to prevent accidental adherence of the suction cups to articles in a purse or travel bag used to transport the mirror.

B. Description of Background Art

Some aspects of personal grooming may be performed by observing one's image in a relatively large "wide angle" mirror, which has a flat reflective surface that provides a unity or "1×" magnification. Such mirrors include full length wall mirrors, dresser mirrors, and bathroom mirrors mounted on a wall or cabinet. Certain personal grooming functions such as applying cosmetics and the like are more easily performed while viewing a larger image of one's face, which can be provided by positioning the face closer to a flat mirror. Sometimes, however, it is not convenient to position one's face sufficiently close to an existing flat mirror to provide an image of the face that is sufficiently large to enable a desired personal grooming task to be easily performed. In such situations, it would be desirable to have available a mirror having a magnification factor greater than one. Since available counter space in locations such as bathrooms is often at a premium, it would also be desirable to have available a magnifying mirror which could be temporarily attached to a vertical surface, such as that of an existing wall-mounted or cabinet-mounted mirror, and removed upon completion of a grooming task. Accordingly, there is a need for a small, magnifying "spot" mirror which could be attached to an existing larger mirror to enable a person to see image details required to more easily perform personal care functions. It would also be desirable to have a compact travel mirror which includes an integral illumination source, to facilitate use of the mirror in locations which may have less than ideal lighting levels. There are available compact travel mirrors that have suction cups for releasably attaching the mirror to a flat surface. However, the suction cups used on compact mirrors are sometimes prone to adhere to or become entangled with items typically transported in a purse or travel bag. The foregoing considerations were motivating factors in the development by the present inventors of a novel illuminated spot mirror with retractable suction cups.

OBJECTS OF THE INVENTION

An object of the present invention is to provide a small, magnifying "spot" mirror which has suction cups that are extendible from a housing of the mirror to enable temporary attachment of the mirror to a flat surface such as that of a large wall-mounted or cabinet-mounted mirror, and retractable into the housing upon removal of the mirror from a mounting surface to prevent the suction cups from inadvertently adhering to or becoming entangled with items typically conveyed in a purse or travel bag.

Another object of the invention is to provide a retractable suction cup spot mirror which includes a battery-powered illuminator that is effective in obliquely illuminating objects positioned in front of a reflective mirror plate of the spot mirror.

Various other objects and advantages of the present invention, and its most novel features, will become apparent to those skilled in the art by perusing the accompanying specification, drawings, and claims.

It is to be understood that although the invention disclosed herein is fully capable of achieving the objects and providing the advantages described, the characteristics of the invention described herein are merely illustrative of the preferred embodiments. Accordingly, we do not intend that the scope of our exclusive rights and privileges in the invention be limited to details of the embodiments described. We do intend that equivalents, adaptations, and modifications of the invention reasonably inferable from the description contained herein be included within the scope of the invention as defined by the appended claims.

SUMMARY OF THE INVENTION

Briefly stated, the present invention comprehends a compact mirror which is small enough to be carried conveniently in a travel bag, purse, or clothing pocket. The mirror according to the present invention includes a circular pancake-shaped housing which contains in a front side thereof a reflective mirror plate that has a concave reflective surface which provides magnified images of objects in front of the mirror, and is thus useful as a "spot" mirror for viewing parts of a person's face in greater detail than provided by a flat mirror. A spot mirror according to the present invention includes an integral illumination source which extends outwardly and upwardly from a circular side wall of the housing. The illumination source is powered by a battery located within the housing, and directs light through a window that is angled upwardly and towards a longitudinal center line of the mirror plate. This arrangement is effective in providing oblique illumination of objects such as a person's face that are being viewed in the mirror. The oblique illumination helps to avoid subjecting a user to uncomfortably bright illumination of the eyes.

The illuminated spot mirror according to the present invention includes a circumferentially spaced-apart array of suction cups that are re-postionably attached to the bottom wall of the mirror housing. According to a novel aspect of the invention, each suction cup is slidably mounted to the bottom wall of the mirror housing. The slidable mountings enable the suction cups to be slid radially outwards from a cavity in the bottom wall of the mirror housing to a use position extended outwardly from the cavity. In the outwardly extended use position, lower sealing surfaces of the suction cups are positioned in a plane located below the bottom wall of the mirror housing. In this configuration, the spot mirror can be easily attached temporarily to and removed from a flat surface such as that of a larger flat mirror mounted to a wall or bathroom cabinet. The spot mirror is attached to a mounting surface by pressing the mirror housing towards the mounting surface, thereby hermetically sealing the lower surfaces of the suction cups to the mounting surface. When the spot mirror according to the present invention is to be transported, the spot mirror is pulled away from the mounting surface to remove it. Each suction cup of the spot mirror is then re-positioned by sliding it radially inwardly into a retracted position within the cavity provided for that suction cup. With all suction cups re-positioned to retracted positions, the retractable suction cup spot mirror according to the present invention can be carried in a conveyance such as a purse, travel bag, pocket, or the like, without the possibility of the suction cups accidentally adhering to or becoming entangled with other items being carried.

DESCRIPTION OF THE PREFERRED EMBODIMENT

Figure 4:
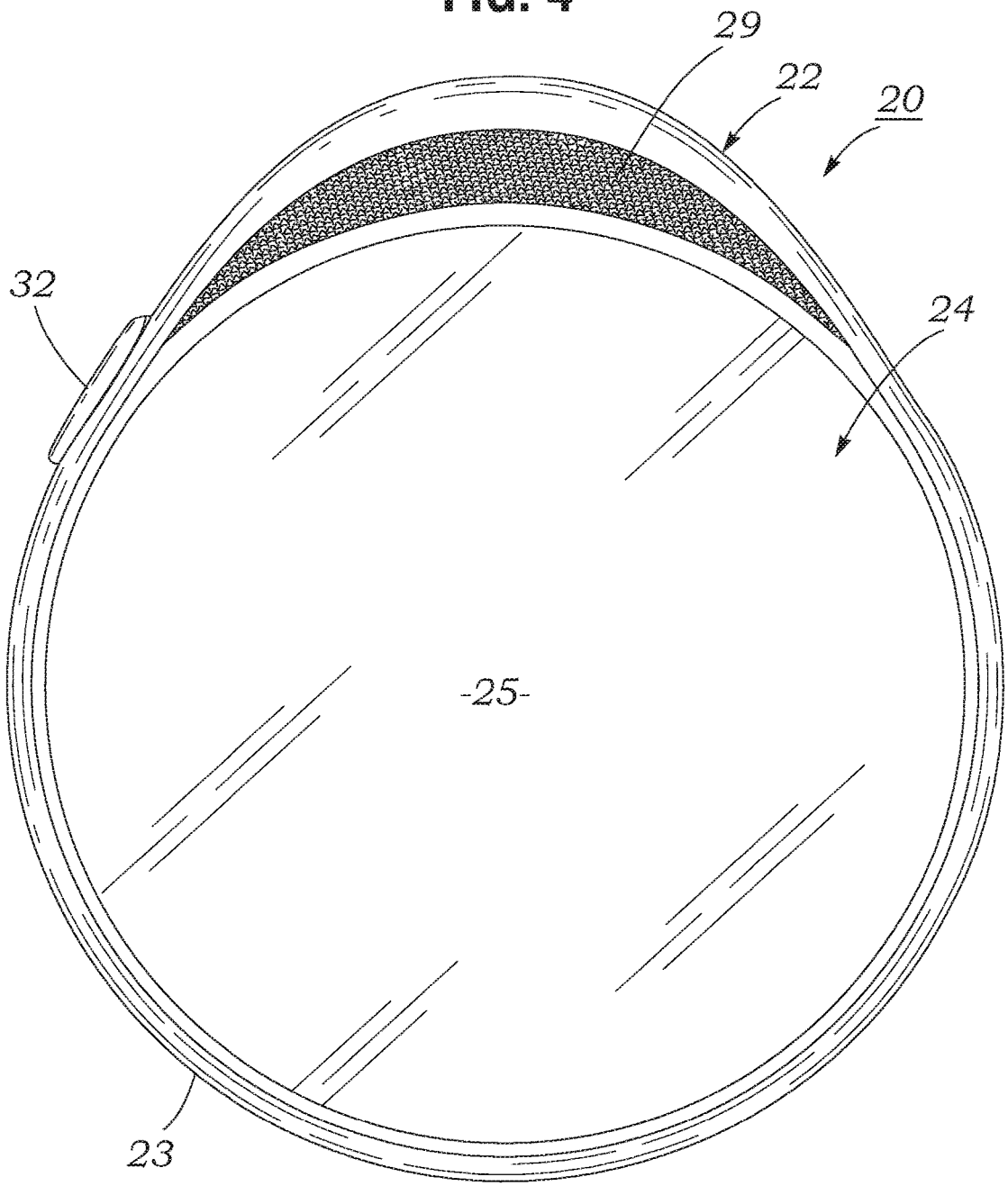
FIG. 4 is a top plan view of the spot mirror of FIG. 1, with mounting suction cups thereof in a retracted transport configuration.
Figure 5:
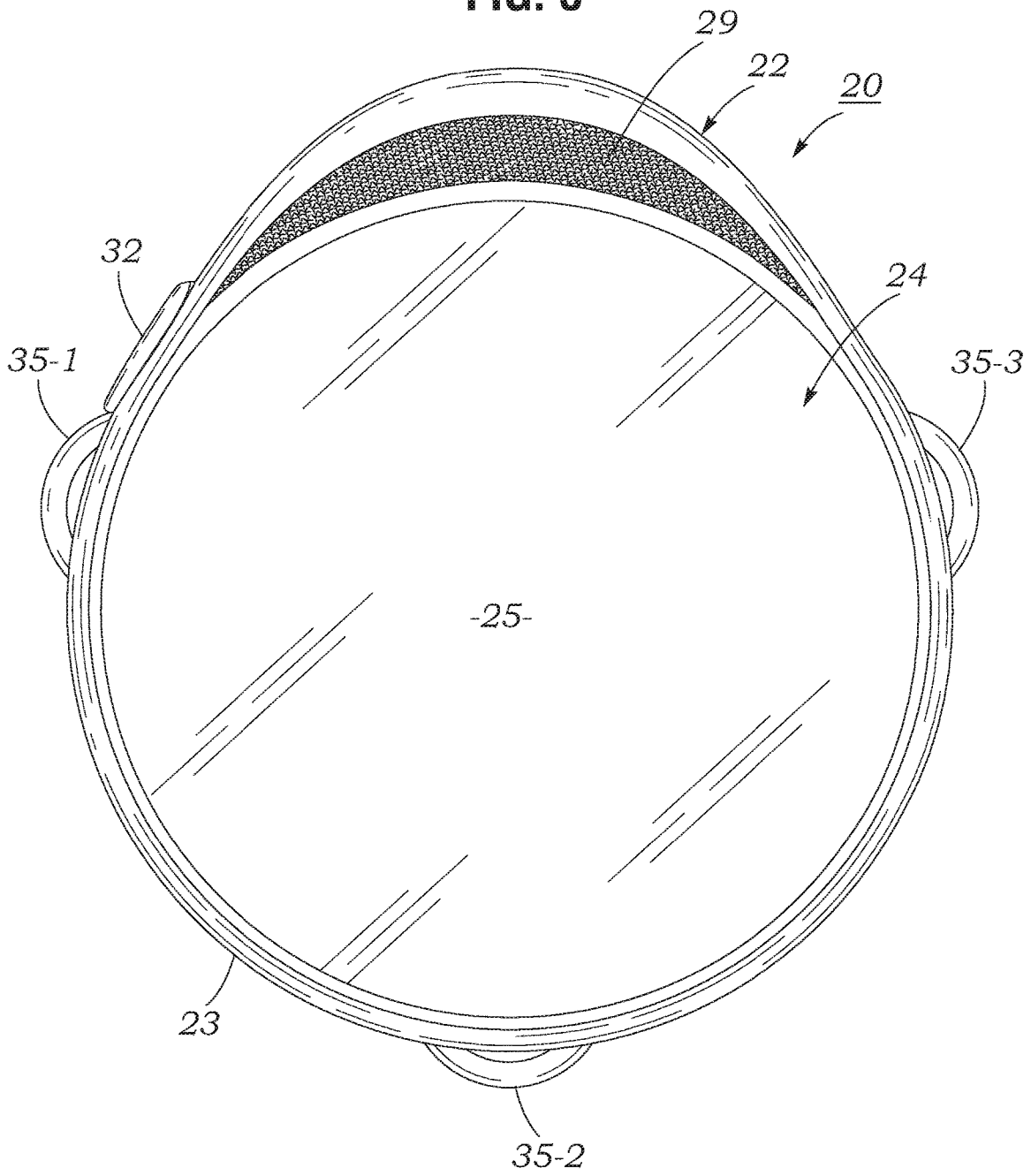
FIG. 5 is a top plan view of the mirror of FIG. 1, with mounting cups thereof in an extended mounting configuration.

FIGS. 1-13 illustrate an Illuminated Retractable Suction Cup Mount Spot Mirror 20 according to the present invention. As may be seen best by referring to FIGS. 1, 4, and 6, mirror 20 includes a thin, pancake-shaped housing 21 which has a generally circular plan-view. Mirror 20 includes a thin, laterally symmetric, crescent-shaped illuminator section 22 that extends radially outwards from and angles outwardly and upwardly from a circularly-shaped upper peripheral wall 23 of housing 21. As shown in the figures, upper peripheral wall 23 of mirror housing 21 circumscribes a circular reflective mirror plate 24. Mirror plate 24 preferably has a concave reflective imaging surface 25 that provides magnified reflected images of objects located near the imaging surface. The images are magnified by 5×, 7×, etc., depending on the radius of curvature of concave reflective surface 25.

Figure 1:
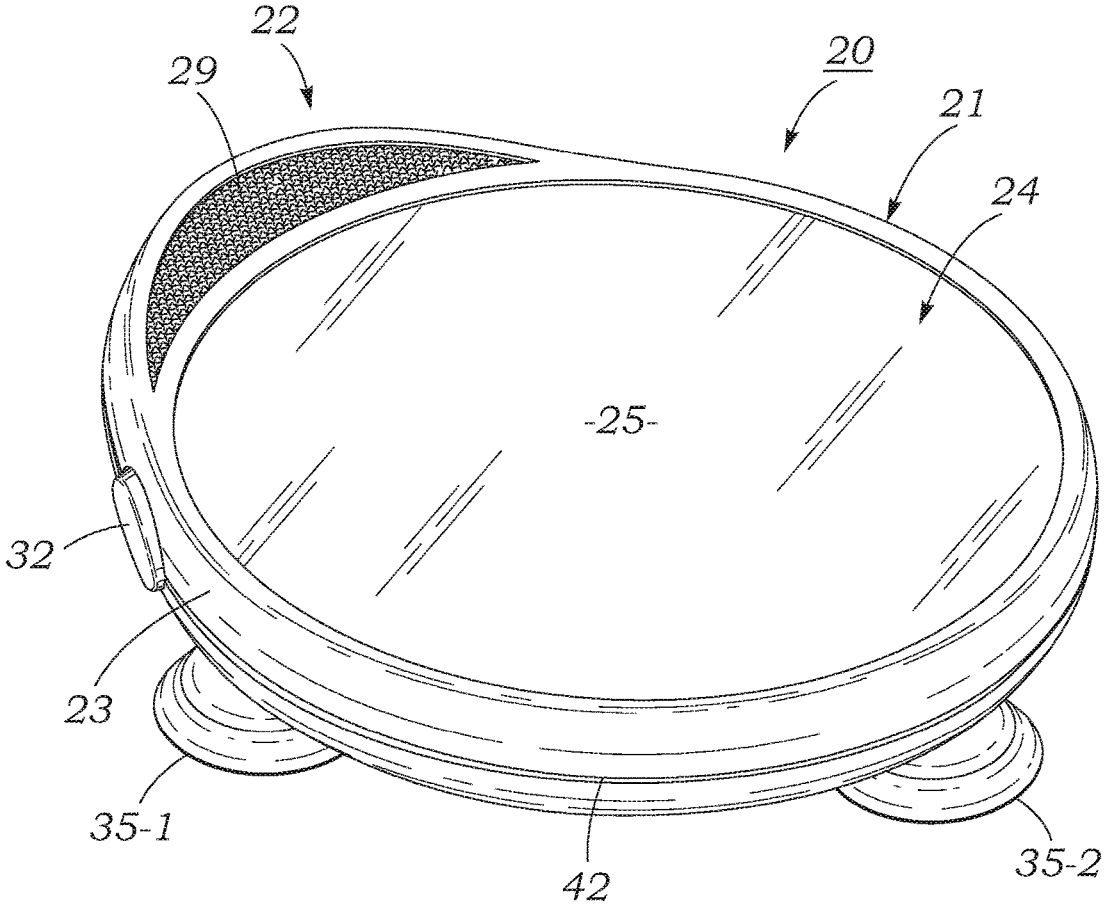
FIG. 1 is a an upper perspective view of a Retractable Suction Cup Mount Portable Spot Mirror according to the present invention, on an enlarged scale.
Figure 6:
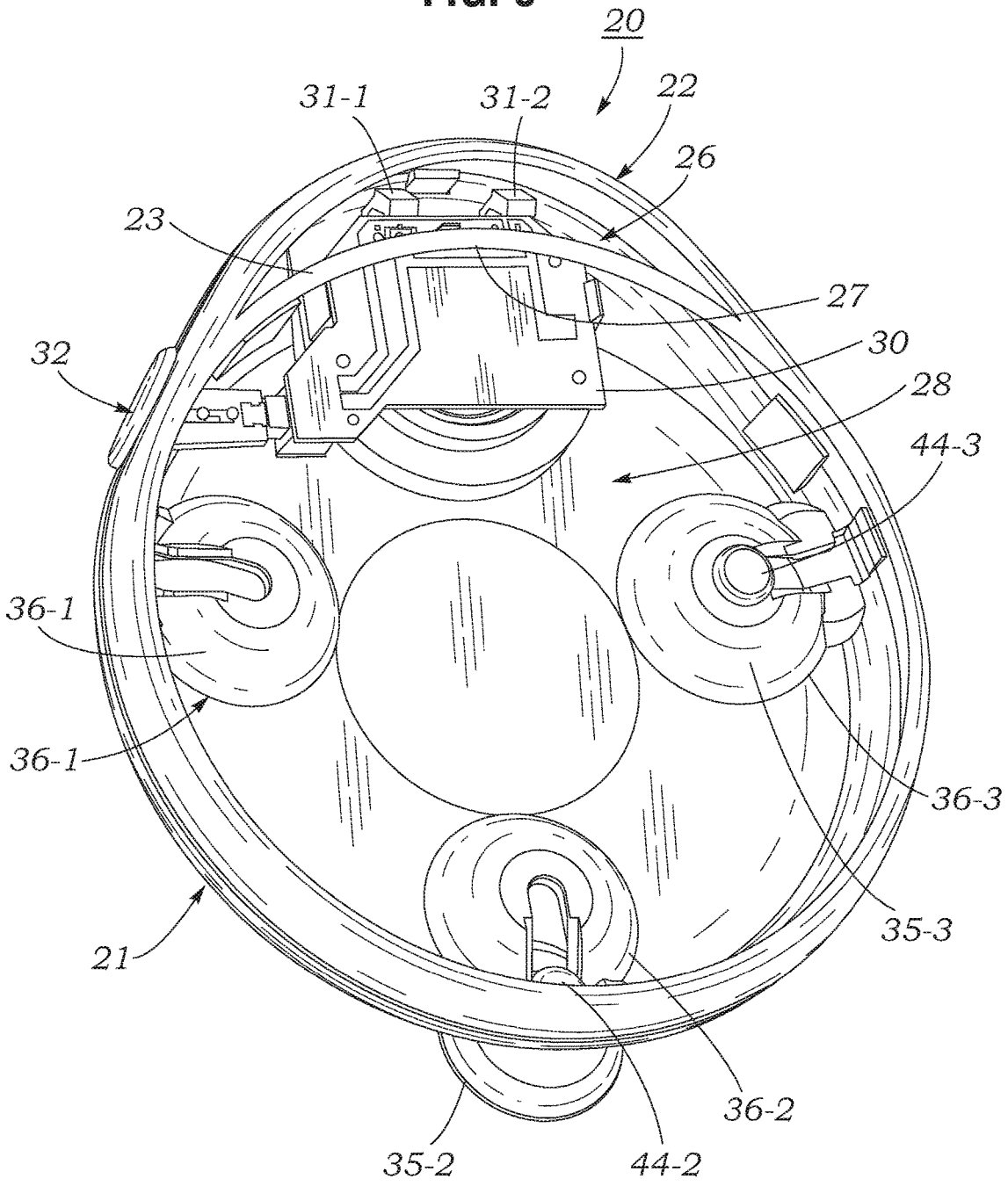
FIG. 6 is a broken-away upper perspective view of the spot mirror of FIG. 6.
Figure 7:
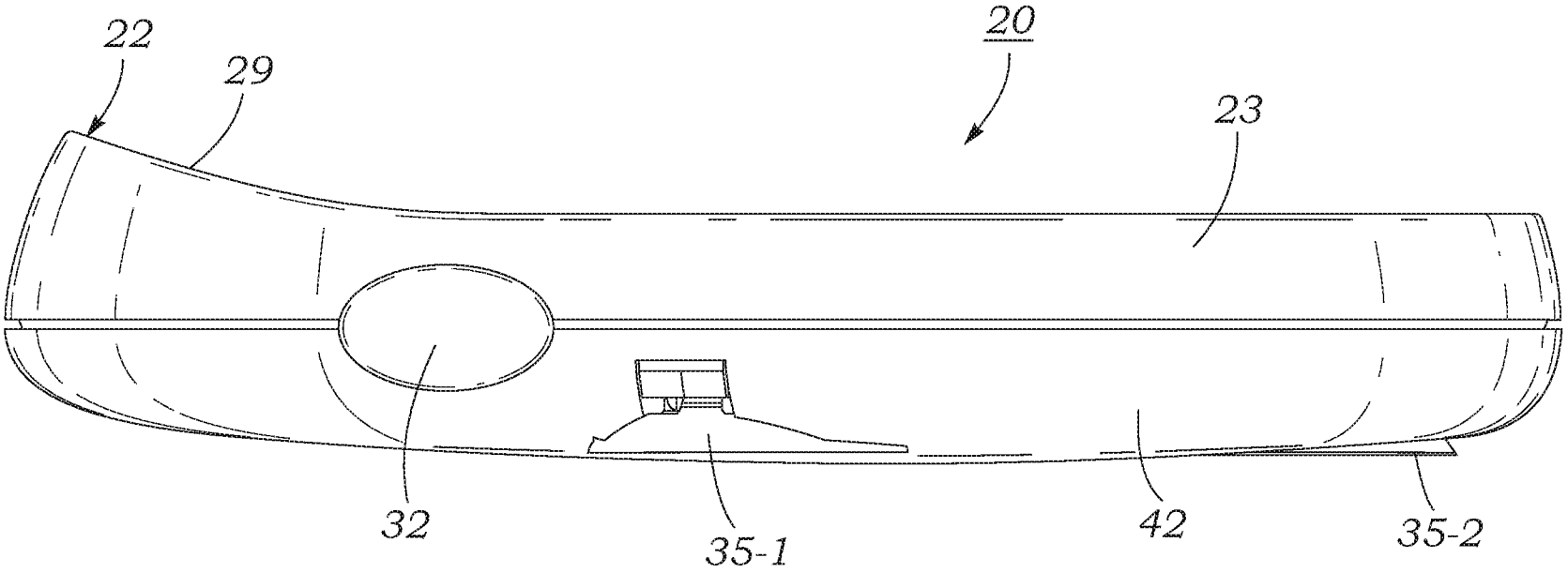
FIG. 7 is a left-side elevation view of the spot mirror of FIG. 1, showing mounting suction cups thereof in a retracted transport configuration.
Figure 8:
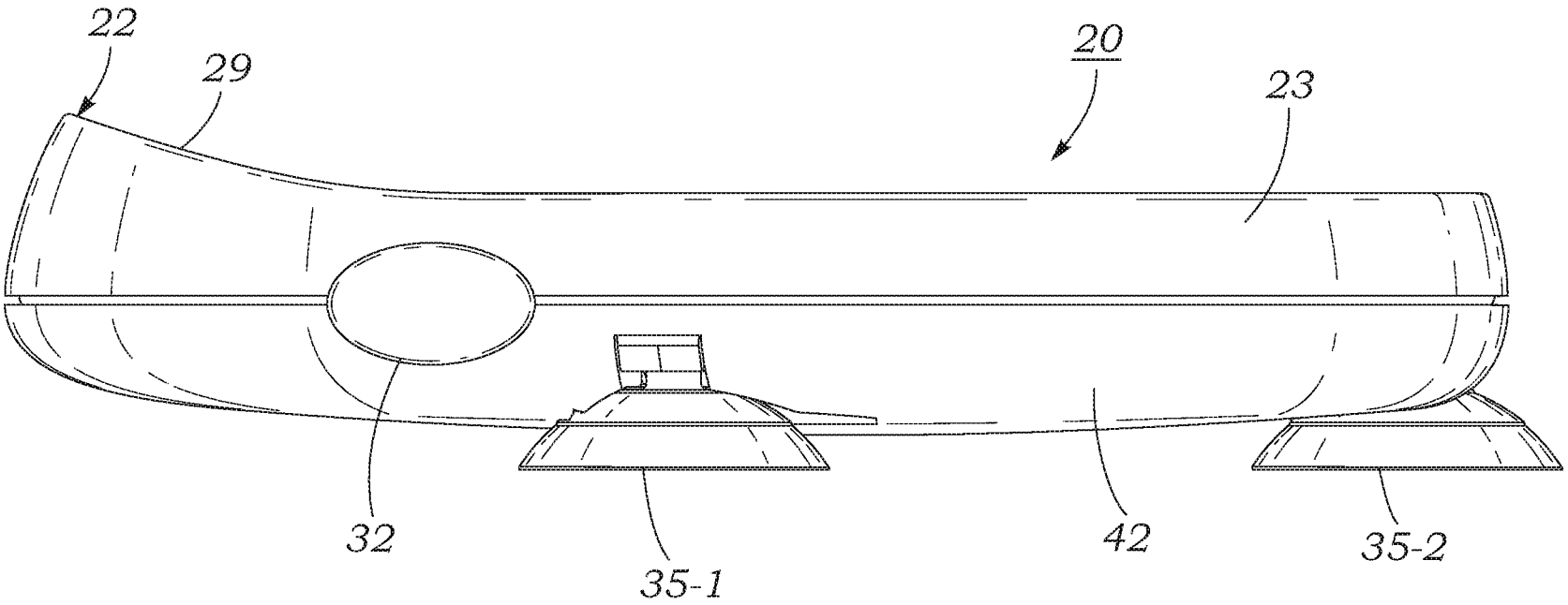
FIG. 8 is a left side elevation view of the spot mirror of FIG. 1, showing mounting suction cups thereof in extended use position.
Figure 9:
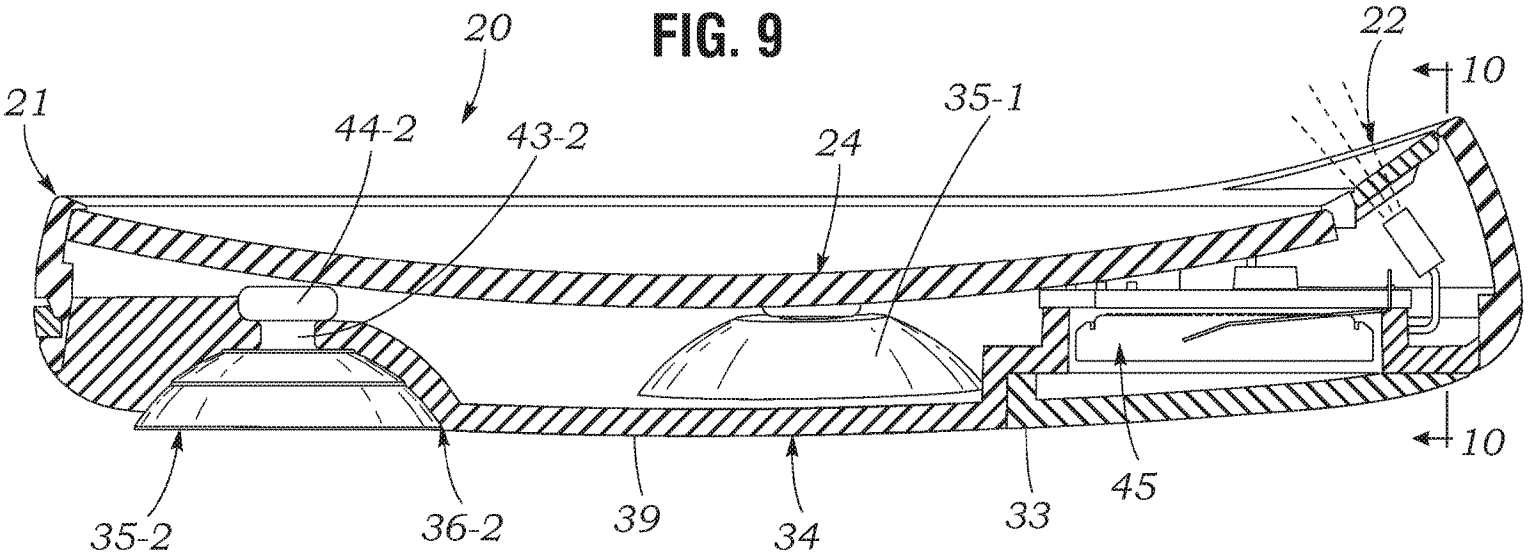
FIG. 9 is a right-side medial longitudinal sectional view of the spot mirror of FIG. 1, showing mounted suction cups thereof in a retracted transport configuration.
Figure 10:
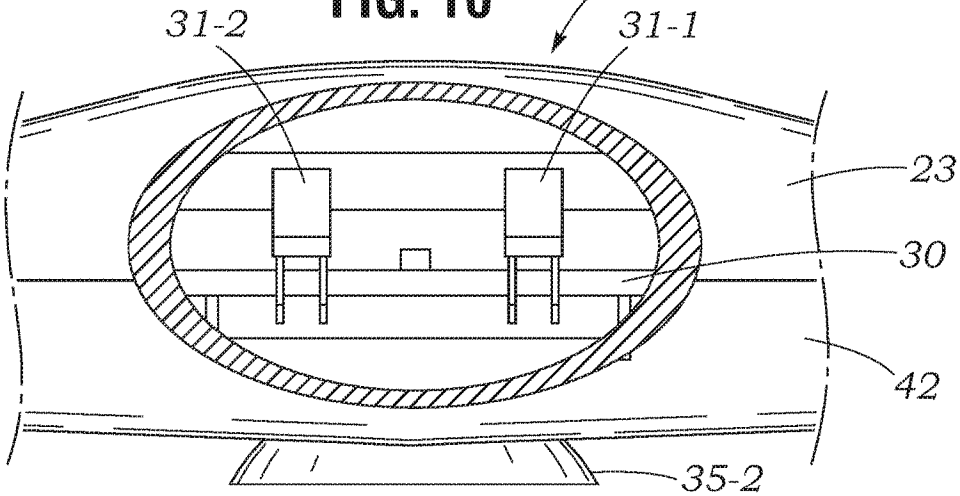
FIG. 10 is a transverse sectional view of the spot mirror of FIG. 9, taken in the direction 10-10.

As may be understood by referring to FIGS. 1 and 6, illuminator section 22 of mirror 20 has a crescent-shaped plan-view outer wall and an interior space 26 which is connected through a rectangular opening 27 through an adjacent part of upper peripheral wall 23 of the mirror housing 21, to a circular plan-view interior space 28 located inwardly of mirror plate 24. As shown in the figures, illuminator section 22 of mirror 20 has an upper diffusely light-transmissive window 29 that covers interior space 26 of the illuminator section. Interior space 26 of illuminator section 22 contains a printed circuit board 30 on which are mounted one or more LED's 31. As may be seen best by referring to FIGS. 6 and 10, illuminator section 22 of mirror 20 preferably includes two laterally spaced-apart LED's 31-1, 31-2. As shown in FIGS. 6 and 9, LED's 31 are angled upwardly towards an inner surface of illuminator window 29.

As may be understood by referring to FIG. 9, light rays emitted from the exit faces of LED's 31 are incident at substantially perpendicular angles on the innerflat surface 29A of window 29. With this arrangement, the light rays emitted by LED's 31 are transmitted with little attenuation through window 29, and are effective in obliquely illuminating an object such as a person's face which may be positioned in front of the reflective surface 25 mirror plate 24.

LED's 31 are connected through an ON/OFF switch 32 that is mounted through the wall of mirror housing 21 to a battery compartment 45 located below illuminator section 22. As may be understood by referring to FIG. 1, the battery compartment is accessible through an access cover 33 located in the bottom wall 34 of housing 21.

Figure 11:
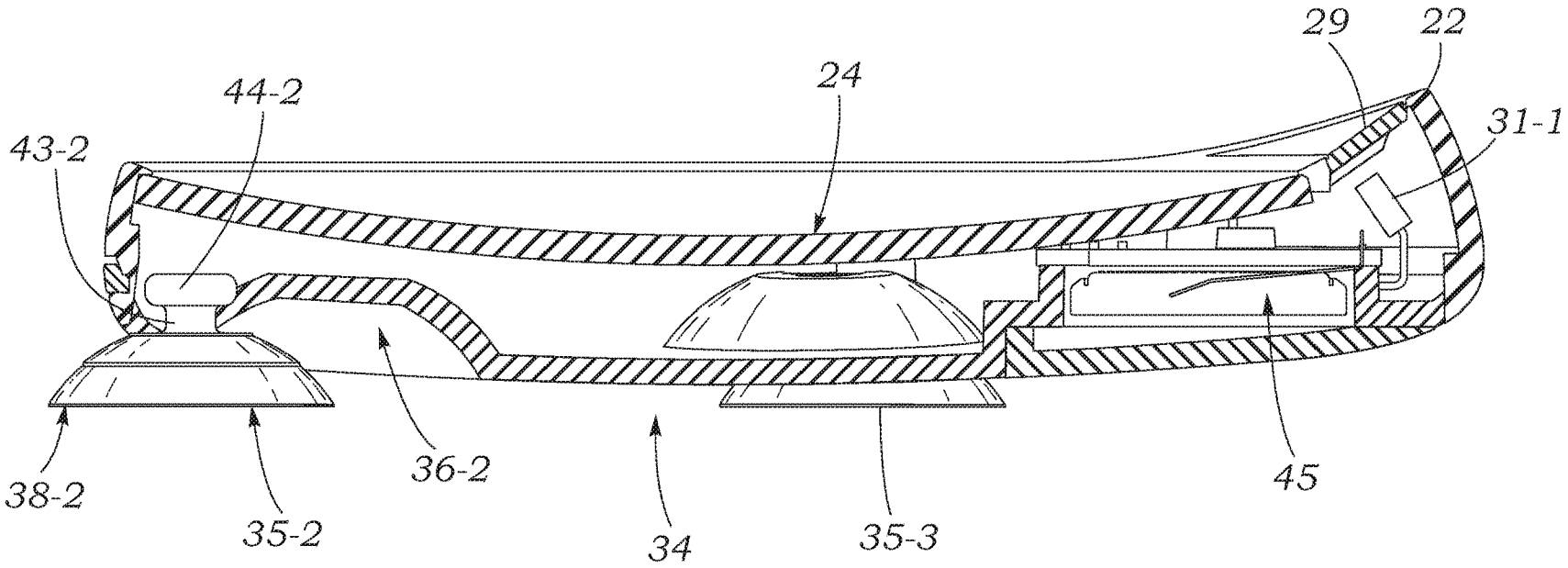
FIG. 11 is a left-side medial sectional view of the spot mirror of FIG. 1, with mounting suction cups of the spot mirror in extended mounting positions.
Figure 12:
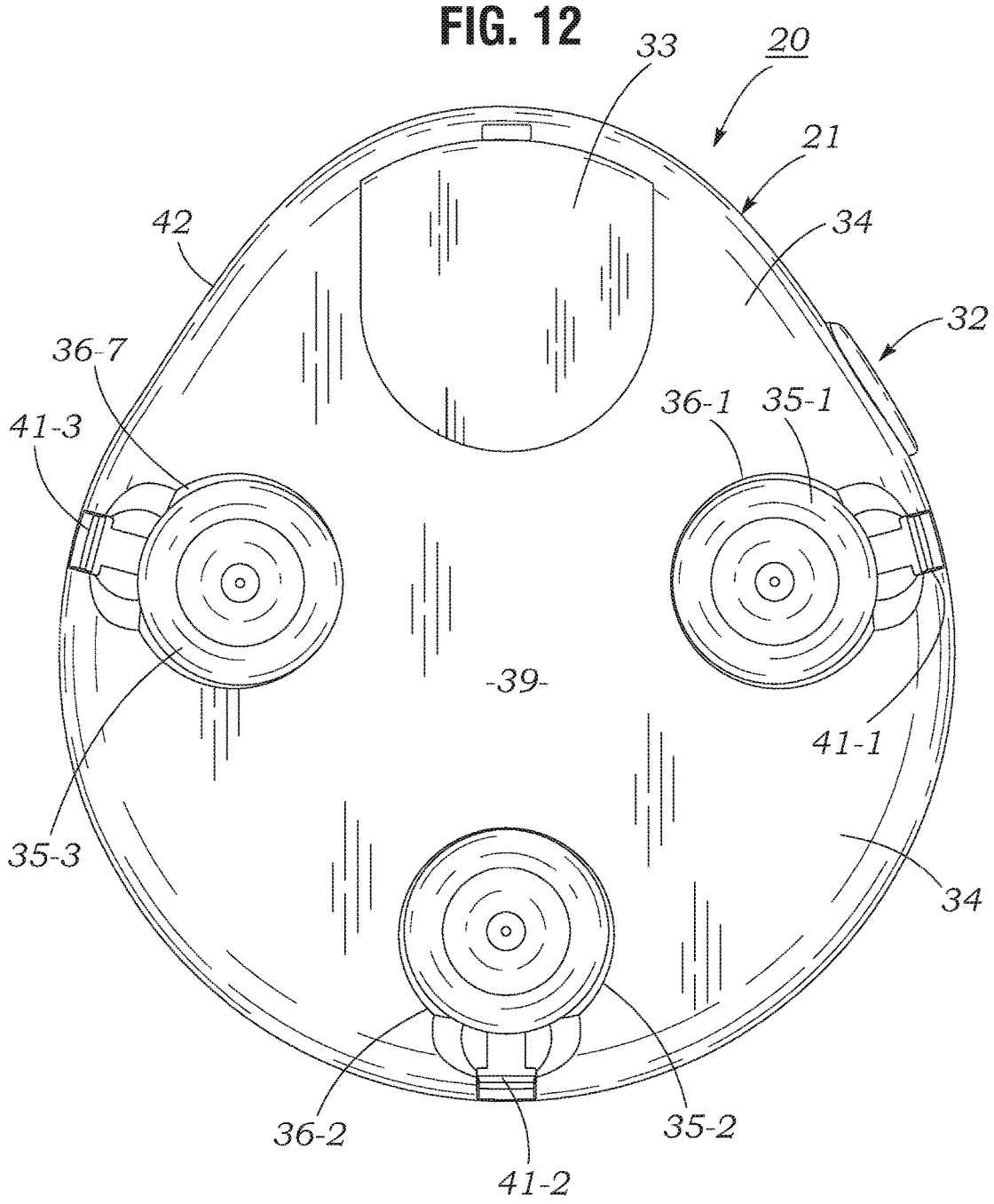
FIG. 12 is a bottom plan view of the spot mirror of FIG. 1, showing mounting suction cups thereof in a retracted transport configuration.
Figure 13:
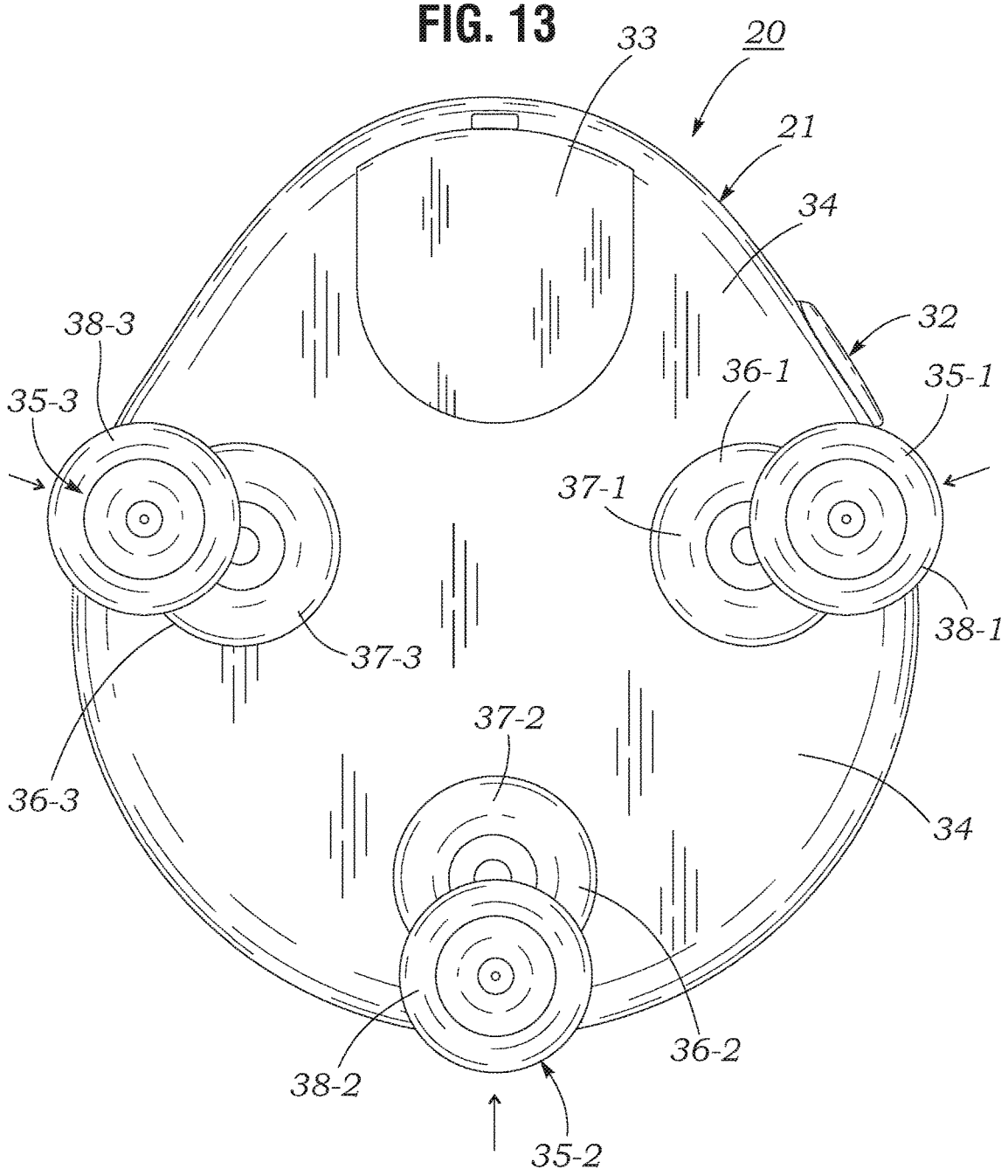
FIG. 13 is a bottom plan view of the spot mirror of FIG. 1, showing mounting suction cups thereof in an extended use position.

As shown in FIGS. 12 and 13, mirror 20 includes three circumferentially spaced-apart suction cups 35-1, 35-2, 35-3 that are re-positionably attached to bottom wall 34 of mirror housing 21. As may be best understood by referring to FIGS. 2, 3, 7-9, and 11, suction cups 35-1, 35-2, and 35-3 are slidably mounted in cavities 36-1, 36-2, 36-3 in bottom wall 34 of housing 21. As may be seen best by referring to FIGS. 2 and 11, each cavity 36 has a shallow concave circular inner section 37 which is disposed inwardly into lower surface 39 of bottom wall 34 of housing 21.

The inner section 37 of each suction cup cavity 36 has a size and shape which conforms to the lower cup-shaped part 38 of a suction cup 35. Thus when the suction cups 35 are retracted into cavities 36, the bottom surfaces of the suction cups are moved into substantially flush alignment with the lower surface 39 of bottom wall 34 of housing 21. In these retracted positions, suction cups 35 are prevented from accidentally adhering to items typically contained in a purse or travel bag in which the mirror may be transported. Moreover, the stem of each suction cup is also retracted into housing 21 along with the lower cup parts of the suction cup, thus preventing the stems from becoming entangled with other transported items.

Figure 2:
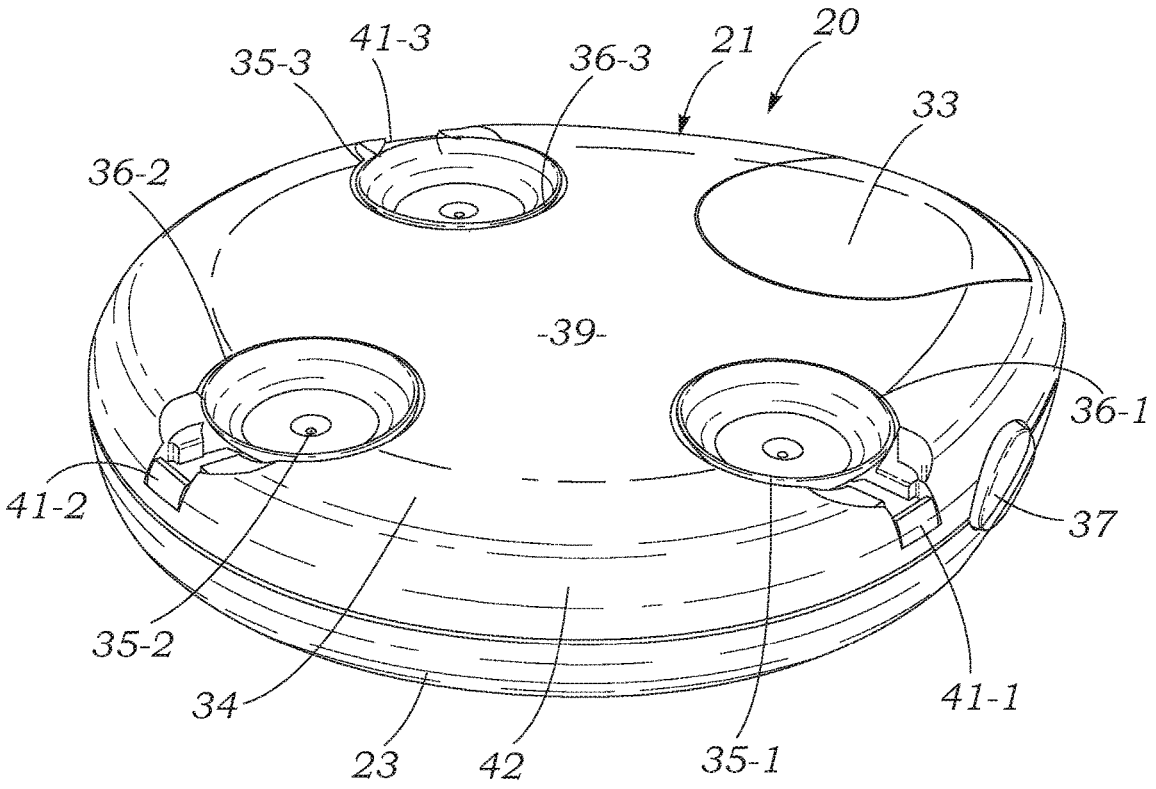
FIG. 2 is a lower perspective view of the spot mirror of FIG. 1.
Figure 3:
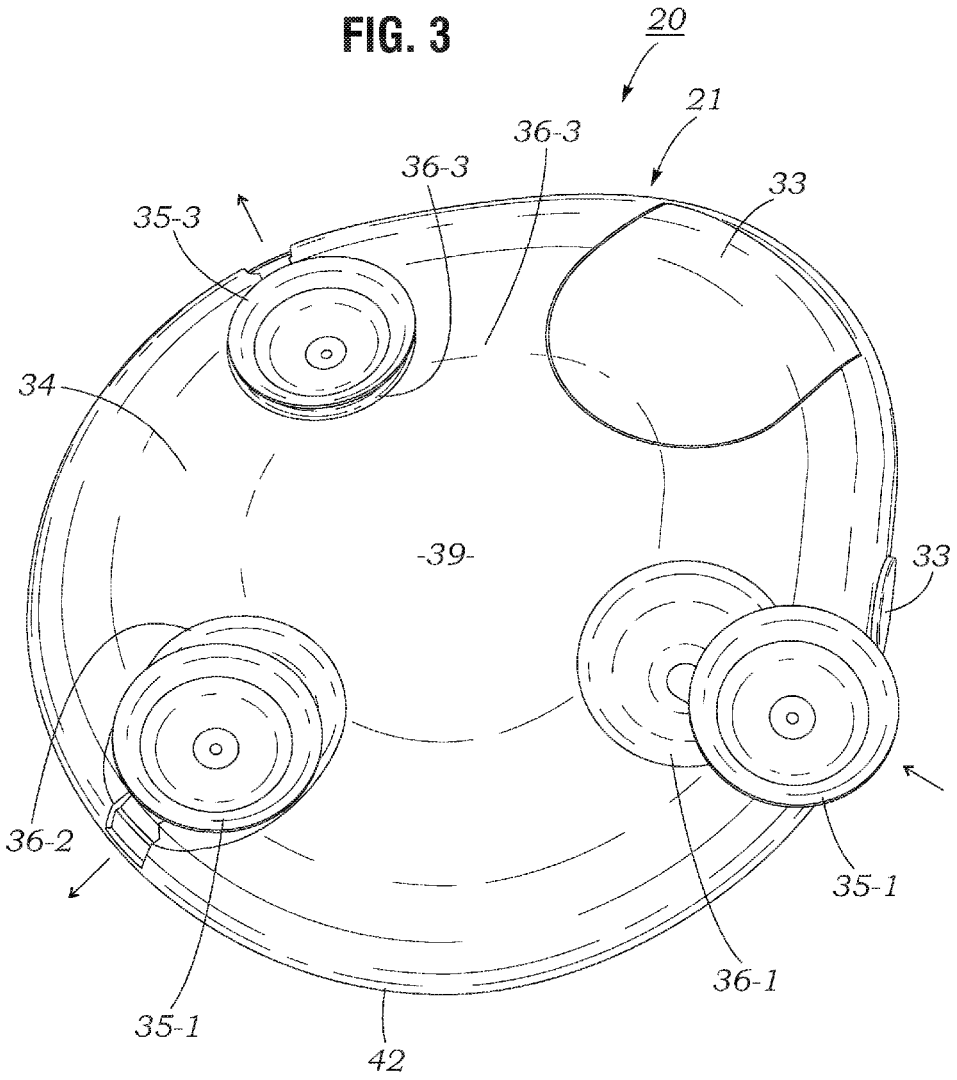
FIG. 3 is a lower perspective view of the spot mirror of FIG. 1, showing one of the mounting suction cups of the spot mirror in an extended use position.

As shown in FIG. 2, each suction cup cavity 36 also includes a rectangularly shaped entrance slot 41 that extends radially outwards from the inner circular part of the cavity, through a lower outer peripheral wall 42 of the mirror housing. Each entrance slot 41 has a width slightly greater than the diameter of the stem 43 of a suction cup, and less than the diameter of a rounded head 44 of the suction cup. With this construction, each suction cups 36 may be readily grasped and slid outwardly to an extended position as shown in FIG. 12, and re-positioned by sliding the suction cup inwardly into a retracted position for storage and transit, as shown in FIG. 11.

What is claimed is:

1. A mirror comprising:

a. a housing having a front side and a rear wall, b. a reflective mirror plate retained within said front side of said housing, c. at least a first suction cup attached to said rear wall of said housing, said suction cup having an outer ring-shaped resilient sealing surface which is hermetically sealable to a flat surface, and d. a first suction cup cavity defined in said rear wall of said housing, said first suction cup cavity enabling reversible movement of said first suction cup between a first, outward position in which said sealing surface of said first suction cup is positioned outwards from said first suction cup cavity of said rear wall of said housing, and a second, retracted position in which said sealing surface is retracted at least partially inwards into said first suction cup cavity of said rear wall of said housing.

2. The mirror of claim 1 further including a second suction cup attached to said rear wall of said housing, said second suction cup having an outer ring-shaped resilient sealing surface which is hermetically sealable to a flat surface, and a second suction cup cavity of said rear wall of said housing, said second suction cup cavity enabling reversible movement of said second suction cup between a first, outward position in which said sealing surface of said second suction cup is positioned outwards from said second suction cup cavity of said rear wall of said housing, and a second, retracted position in which said sealing surface is retracted at least partially inwards into said second suction cup cavity of said rear wall of said housing.

3. The mirror of claim 2, wherein said first and second suction cups are spaced equal distances from the center of said rear wall of said housing.

4. The mirror of claim 3, wherein when each of said first and second suction cups is in said first outward position, said outer ring-shaped resilient sealing surface of each of said first and second suction cups is positioned in a plane located outwardly of said rear wall of said housing.

5. The mirror of claim 2 further including a third suction cup attached to said rear wall of said housing, said third suction cup having an outer ring-shaped resilient sealing surface which is hermetically sealable to a flat surface, and a third suction cup cavity defined in said rear wall of said housing, said third suction cup cavity enabling reversible movement of said third suction cup between a first, outward position in which said sealing surface of said third suction cup is positioned outwards from said third suction cup cavity of said rear wall of said housing, and a second, retracted position in which said sealing surface is retracted at least partially inwards into said third suction cup cavity of said rear wall of said housing.

6. The mirror of claim 5, wherein when each of said first, second and third suction cups is in said first outward position, said outer resilient sealing surface of each of said first, second and third suction cups is positioned in a plane located outwardly of said rear wall of said housing.

7. The mirror of claim 6, wherein each of said first, second and third suction cup cavities of each of said first, second and third suction cups comprises in combination a recess in said rear wall of said housing for conformally receiving an outer cup-shaped part of a suction cup, and an entrance slot extending radially outwards from said recess for radially slidably receiving a stem part of a suction cup.

8. A mirror comprising:

a. a housing having a front side and a rear wall, b. a reflective mirror plate retained within said front side of said housing, and c. an illuminator section that extends radially outward from an upper peripheral wall of said housing, said illuminator section comprising an illumination source and a light-transmissive window which is angled upwardly and inwardly towards a longitudinal center line of said reflective mirror plate.

9. The mirror of claim 8, wherein said illumination source comprises at least one LED.

10. The mirror of claim 9 further including a battery power supply operatively interconnected with said illumination source.

11. A mirror comprising:

a housing having a front side and a rear wall;

a reflective mirror plate retained within said front side of said housing;

a suction cup having a resilient sealing surface which is hermetically sealable to a flat surface; and a suction cup cavity recessed in said rear wall of said housing, said suction cup being slidably mounted to said housing within said suction cup cavity such that said suction cup is movable between a first, outward position in which said sealing surface of said suction cup is positioned outwards of said rear wall, and a second, retracted position in which said sealing surface is substantially flush with said rear wall.

12. The mirror of claim 11 further comprising an illumination section in said front side, said illumination section comprising an illumination source.

13. The mirror of claim 12 wherein said illumination source is positioned to provide oblique illumination of a person's face when being viewed in said reflective mirror plate.

14. The mirror of claim 8 further including:

a. at least a first suction cup attached to said rear wall of said housing, said first suction cup having an outer ring-shaped resilient sealing surface which is hermetically sealable to a flat surface, and b. a first suction cup cavity defined in said rear wall of said housing, said first suction cup cavity enabling reversible movement of said first suction cup between a first, outward position in which said sealing surface of said first suction cup is positioned outwards of said rear wall of said housing, and a second, retracted position in which said sealing surface of said first suction cup is retracted at least partially inwards of said rear wall of said housing.

15. The mirror of claim 14 further including a second suction cup, and a second suction cup cavity defined in said rear wall of said housing, said second suction cup cavity enabling reversible movement of said second suction cup between a first, outward position in which said sealing surface of said second suction cup is positioned outwards of said rear wall of said housing, and a second, retracted position in which said sealing surface of said second suction cup is retracted at least partially inwards of said rear wall of said housing.

16. The mirror of claim 15, wherein said first and second suction cups are spaced equal distances from the center of said rear wall of said housing.

17. The mirror of claim 15, wherein when said second suction cup is in the first, outward position, said outer ring-shaped resilient sealing surfaces of said second suction cup is positioned in a plane located outwardly of said rear wall of said housing.

18. The mirror of claim 15 further including a third suction cup attached to said rear wall of said housing, and a third suction cup cavity defined in said rear wall of said housing, said third suction cup cavity enabling reversible movement of said third suction cup between a first, outward position in which said sealing surface of said third suction cup is positioned outwards of said rear wall of said housing, and a second, retracted position in which said sealing surface of said third suction cup is retracted at least partially inwards of said rear wall of said housing.

19. The mirror of claim 18, wherein when each of said first, second and third suction cups is in said first outward position, said outer resilient sealing surface of each of said first, second and third suction cups is positioned in a plane located outwardly of said rear wall of said housing.

20. The mirror of claim 19, wherein each of said first, second and third suction cup cavities comprises in combination a recess in said rear wall of said housing for conformally receiving an outer cup-shaped part of a suction cup, and an entrance slot extending radially outwards from said recess for radially slidably receiving a stem part of a suction cup.

* * * * *